US008445844B2

(12) United States Patent
Mukaibatake et al.

(10) Patent No.: US 8,445,844 B2
(45) Date of Patent: May 21, 2013

(54) QUADRUPOLE MASS SPECTROMETER

(75) Inventors: Kazuo Mukaibatake, Kyoto (JP); Shiro Mizutani, Uji (JP); Shuichi Kawana, Osaka (JP)

(73) Assignee: Shimadzu Corporation, Kyoto (JP)

( * ) Notice: Subject to any disclaimer, the term of this patent is extended or adjusted under 35 U.S.C. 154(b) by 518 days.

(21) Appl. No.: 12/160,963

(22) PCT Filed: Jun. 15, 2006

(86) PCT No.: PCT/JP2006/312024
§ 371 (c)(1),
(2), (4) Date: Jul. 15, 2008

(87) PCT Pub. No.: WO2007/083403
PCT Pub. Date: Jul. 26, 2007

(65) Prior Publication Data

US 2010/0193684 A1 Aug. 5, 2010

(30) Foreign Application Priority Data

Jan. 20, 2006 (JP) ..... 2006-012600

(51) Int. Cl.
*H01J 49/42* (2006.01)

(52) U.S. Cl.
USPC ..... 250/292; 250/283; 250/288

(58) Field of Classification Search
USPC ..... 250/292
See application file for complete search history.

(56) References Cited

U.S. PATENT DOCUMENTS 6,472,661 B1 * 10/2002 Tanaka et al. ..... 250/281
6,610,979 B2 * 8/2003 Harada ..... 250/292
6,646,254 B2 * 11/2003 Tanaka ..... 250/288
7,078,686 B2 * 7/2006 Roushall et al. ..... 250/292
7,323,682 B2 * 1/2008 McCauley et al. ..... 250/287

FOREIGN PATENT DOCUMENTS

JP 2002-025498 A 1/2002
JP 3478169 B2 10/2003

OTHER PUBLICATIONS

Japanese Office Action for corresponding Japanese Patent Application No. 2007-554804, dated Sep. 14, 2010 (w/English Translation).

* cited by examiner

*Primary Examiner* — Phillip A Johnston
(74) *Attorney, Agent, or Firm* — Sughrue Mion, PLLC

(57) ABSTRACT

A table (21) for relating an appropriate DC bias voltage to each of a plurality of selectable scan speeds is stored beforehand in an auto-tuning data memory section (20). In an auto-tuning operation, a controller (10) determines the DC bias voltage corresponding to each scan speed by referring to the table (21) and fixes the output of an ion-drawing voltage generator (13) at that voltage. Subsequently, while changing the voltages applied to relevant sections such as an ion optical system (2), the controller (10) finds voltage conditions under which the detection signal is maximized. The conditions thus found are stored in an auto-tuning result data (22). In an analysis of a target sample, a DC bias voltage corresponding to a scan speed specified by an operator is obtained from the DC bias voltage table (21), and the optimal conditions for this voltage are obtained from the auto-tuning result data (22). Based on these items of information, conditions for the scan measurement are determined. This method prevents the deterioration in detection sensitivity, which will otherwise take place if the scan measurement is performed at a high scan speed.

8 Claims, 6 Drawing Sheets

| SCAN SPEED | DC BIAS VOLTAGE |
|---|---|
| SS1 | Vdc1 |
| SS2 | Vdc2 |
| SS3 | Vdc3 |
| SS4 | Vdc4 |
| ⋮ | ⋮ |
| SS10 | Vdc10 |

| SCAN SPEED | MASS-TO-CHARGE RATIO | DC BIAS VOLTAGE |
|---|---|---|
| SS1 | m/z1<br>m/z2<br>⋮ | Vdc11<br>Vdc12<br>⋮ |
| SS2 | m/z1<br>m/z2<br>⋮ | Vdc21<br>Vdc22<br>⋮ |
| ⋮ | ⋮ | ⋮ |

| SCAN SPEED [amu/sec] | MEASUREMENT TIME PER ONE MASS UNIT [sec] |
|---|---|
| 1000 | 1.000E-03 |
| 2000 | 5.000E-04 |
| 4000 | 2.500E-04 |
| 6000 | 1.667E-04 |
| 10000 | 1.000E-04 |
| 15000 | 6.667E-05 |

QUADRUPOLE MASS SPECTROMETER

TECHNICAL FIELD

The present invention relates to a quadrupole mass spectrometer using a quadrupole mass filter as a mass analyzer for separating ions according to their mass-to-charge ratios (m/z).

BACKGROUND ART

The quadrupole mass spectrometer is a well-known type of mass spectrometer using a quadrupole mass filter as a mass analyzer for separating ions according to their mass-to-charge ratios. FIG. 11(*a*) is a schematic diagram showing the configuration of a typical quadrupole mass spectrometer. In this quadrupole mass spectrometer, sample molecules are ionized by an ion source 1, such as an electron-impact ionizer. The ions thus produced are then converged (and accelerated in some cases) by an ion optical system 2, such as an ion lens, and introduced into a space extending along the major axis of a quadrupole mass filter 3 consisting of four rod electrodes. A voltage generated by superposing a direct-current (DC) voltage on a radio-frequency voltage is applied to each of the four electrodes of the quadrupole mass filter 3 so as to select ions in such a manner that an ion having a specific mass-to-charge ratio corresponding to the applied voltages is selectively allowed to pass through the axially extending space while other ions are diverged halfway. The ions that have passed through the quadrupole mass filter 3 are introduced into a detector 4, from which electrical signals corresponding to the amount of the ions are extracted.

The mass-to-charge ratio of the ion that can pass through the quadrupole mass filter 3 basically changes according to the amplitude of the radio-frequency voltage and the DC voltage applied to the filter 3. Therefore, it is possible to scan the mass-to-charge ratio of the ion reaching the detector 4 over a predetermined mass range by scanning the aforementioned voltage values so that they increase or decrease with the lapse of time. This is the scan measurement by the quadrupole mass spectrometer. In addition, an ion-drawing bias voltage, which is a DC voltage, is commonly superposed on the ion-selecting voltages applied to the rod electrodes of the quadruple mass filter 3. This bias voltage creates an appropriate DC electric field in a space between the quadruple mass filter 3 and the ion optical system 2 in order to draw ions from that space into the quadrupole mass filter 3.

The scan speed at which the mass-to-charge ratio is scanned during the scan measurement influences the mass resolution in a mass spectrum or the time resolution of a gas chromatograph/mass spectrometer (GC/MS) or liquid chromatograph/mass spectrometer (LC/MS) in creating a mass chromatogram or total ion chromatogram. Therefore, the scan speed is generally provided as one of the condition parameters that can be set by operators according to the purpose of analysis or the kind of sample. In a conventional quadrupole mass spectrometer, the ion-drawing bias voltage applied to the rod electrodes of the quadrupole mass filter 3 is maintained constant even when the scan speed is changed. This method causes the following problem: Let t denote the time required for an ion to pass through the space (length=L) extending along the major axis of the quadrupole mass filter 3, as shown in FIG. 11(*b*). This time t depends on the kinetic energy of the ion at a point in time where the ion has reached the inlet of the quadrupole mass filter 3. As explained earlier, during the scan measurement, the ion-selecting voltages applied to the quadrupole mass filter 3 are scanned so that they will continuously change. This voltage change also takes place while the ion is passing through the axially extending space. As the scan speed is raised, the voltage change $\Delta V$ during the time t becomes larger.

There will be no practical problem if the scanning time is much longer than the passing time of the ion and the voltage change $\Delta V$ is negligibly small. However, if the scan speed is raised (and the scanning time is shortened), the voltage change $\Delta V$ that occurs during the passage of the ion through the quadrupole mass filter 3 becomes larger. If the voltage change $\Delta V$ is too large to be disregarded, a portion of the ions that should pass through the quadrupole mass filter 3 will be prevented from passing through, so that the quantity of ions reaching the detector 4 will decrease. Thus, the detection sensitivity deteriorates as the scan speed is raised.

In view of such a problem, a mass spectrometer disclosed in Patent Document 1 changes the ion-drawing bias voltage applied to the rod electrodes of the quadrupole mass filter 3 according to the scan speed so that the influence of the change in the scanning voltage during the passage of the ions through the quadrupole mass filter 3 is alleviated. Specifically, when the scan speed of the scan measurement is high, the ion-drawing bias voltage is changed so that ions being introduced into the quadrupole mass filter 3 will have higher levels of kinetic energy. This method avoids the aforementioned decrease in the detection sensitivity even when the scan speed is raised.

Generally, quadrupole mass spectrometers have an auto-tuning mechanism for correcting errors between the mass-to-charge ratio that is intended to be selected by applying a specific ion-selecting voltage to the quadrupole mass filter 3 and the mass-to-charge ratio of the ion that has actually passed through the quadrupole mass filter 3 and reached the detector 4, or for determining optimal voltages to be applied to the ion source 1, the ion optical system 2 and other sections (for example, refer to Patent Document 2). In the auto-tuning mode, an auto-tuning operation is performed using a standard sample prepared for mass calibration. In this operation, a component of the standard sample is mass-analyzed and necessary tuning tasks are performed so that the mass-to-charge ratio corresponding to the aforementioned component comes to a predetermined position in the mass spectrum. In another case, the voltages applied to the relevant sections of the apparatus are adjusted so that the detection signal of the aforementioned component is maximized. Information obtained by such tuning operations is stored in a memory device.

The aforementioned auto-tuning operation is performed before an analysis of an unknown sample, i.e. the target sample. Subsequently, when an operator sets condition parameters, such as the mass range and scan speed, the apparatus selects an appropriate voltage-applying pattern and sets voltages to be applied to the relevant sections on the basis of the information stored in the memory device. Under these conditions, the analysis is performed.

However, the auto-tuning operation performed by the previously described quadrupole mass spectrometer does not include determining an appropriate ion-drawing bias voltage for each scan speed. Therefore, changing the ion-drawing bias voltage according to the scan speed during the actual analysis of an unknown sample does not always guarantee that the DC electric field within the space between the quadrupole mass filter 3 and the ion optical system 2 is optimized in terms of maximization of the detection signal of the objective ion. Accordingly, the detection sensitivity is likely to be sacrificed when the speed of scanning the mass-to-charge ratio is set at high levels.

The technique described in Patent Document 1, in which the ion-drawing bias voltage applied to the rod electrodes of the quadrupole mass filter 3 is changed according to the scan speed, hardly ensures high detection sensitivity over the entire mass range. The reason is as follows: Neglecting the initial energy of the ion, the flight speed v of an ion passing through the quadrupole mass filter 3 is theoretically given by the following equation:

$$(1/2)mv^2=eE \quad (1),$$

where E is the ion-drawing bias voltage, m is the mass of the ion, and e is the elementary electric charge ($1.602\times10^{-19}$). From this equation:

$$v=(2eE/m)^{1/2} \quad (2).$$

Accordingly, the time t required for the ion to pass through the quadrupole mass filter 3 having a space length L is given by:

$$t=L/v=L/(2eE/m)^{1/2}=L\times(m/2eE)^{1/2} \quad (3).$$

The relationship between the scan speed and the time required for measuring one mass unit (which is assumed as "1 m/z" in the present case) is as shown in FIG. 12. For example, when the scan speed is 15000 [amu/sec], the measurement time for one mass unit is 66.67 [μsec]. This means that, if the time required for an ion to pass through the quadrupole mass filter 3 is longer than 66.67 [μsec], the ion cannot reach the detector 4 within the data measurement cycle and causes a decrease in the detection sensitivity. As is clear from equation (2), the ion speed v decreases as the mass m increases. This suggests that, even if the detection sensitivity for ions having relatively small mass-to-charge ratios is adequately high, the detection sensitivity for ions having relatively large mass-to-charge ratios is likely to be low. This deterioration in the detection sensitivity can be avoided by raising the ion-drawing bias voltage so that the ions can more quickly pass through. However in this case, the mass resolution of the resulting mass spectrum may deteriorate due to a decrease in the number of oscillations of the ion or dispersion of kinetic energy of the ion within the quadrupole electric field created by the rod electrodes.

Patent Document 1: Japanese Unexamined Patent Application Publication No. 2002-25498

Patent Document 2: Japanese Patent No. 3478169 (Paragraph [0018])

DISCLOSURE OF THE INVENTION

Problem to be Solved by the Invention

The present invention has been achieved to solve the aforementioned problems, and its first objective is to provide a quadrupole mass spectrometer capable of assuredly achieving high levels of detection sensitivity even if the speed of scanning the mass-to-charge ratio is high.

The second objective of the present invention is to provide a quadrupole mass spectrometer capable of exhibiting a high level of ion detection sensitivity even if the scan speed is high, particularly within a range where the mass-to-charge ratio is large, while ensuring a high level of mass resolution within a range where the mass-to-charge is small.

Means for Solving the Problems

To achieve the first objective, a first aspect of the present invention provides a quadrupole mass spectrometer including an ion source for ionizing sample molecules, a quadrupole mass filter for selectively allowing passage of an ion having a specific mass-to-charge ratio among ions produced by the ion source, an ion optical system located between the ion source and the quadrupole mass filter in order to transport the ions produced by the ion source to the quadrupole mass filter, and a detector for detecting an ion that has passed through the quadrupole mass filter, and the quadrupole mass spectrometer is characterized by:

a) a voltage-applying section for applying a DC bias voltage to the quadrupole mass filter in order to create a DC electric field for drawing the ions into the quadrupole mass filter, the DC electric field being created between the quadrupole mass filter and the ion optical system;

b) a memory section for storing beforehand bias voltage information that relates a scan speed at which the mass-to-charge ratio is scanned by the quadrupole mass filter, to the DC bias voltage appropriate for the scan speed;

c) a tuning section for performing a tuning operation in an auto-tuning mode for automatically adjusting a voltage applied to each section, the tuning operation including setting one or more levels of the scan speed, specifying the DC bias voltage for each of the aforementioned level or levels of the scan speed on the basis of the information stored in the memory section, determining a voltage condition for maximizing the intensity of a detection signal produced by the detector under the condition that the specified DC bias voltage is applied to the quadrupole mass filter by the voltage-applying section, and recording the voltage condition; and d) an analysis-performing section for performing an analysis of a target sample when the scan speed is specified as one of the analysis conditions by an operator, the analysis being performed at the DC bias voltage specified on the basis of the bias voltage information stored in the memory section and under the voltage condition determined by the tuning section.

To achieve the second objective, a second aspect of the present invention provides a quadrupole mass spectrometer including an ion source for ionizing sample molecules, a quadrupole mass filter for selectively allowing passage of an ion having a specific mass-to-charge ratio among ions produced by the ion source, an ion optical system located between the ion source and the quadrupole mass filter in order to transport the ions produced by the ion source to the quadrupole mass filter, and a detector for detecting an ion that has passed through the quadrupole mass filter, and the quadrupole mass spectrometer is characterized by:

a) a voltage-applying section for applying a DC bias voltage to the quadrupole mass filter in order to create a DC electric field for drawing the ions into the quadrupole mass filter, the DC electric field being created between the quadrupole mass filter and the ion optical system;

b) a memory section for storing beforehand bias voltage information that relates a scan speed at which the mass-to-charge ratio is scanned by the quadrupole mass filter and the mass-to-charge ratio of an ion to be analyzed, to the DC bias voltage appropriate for the scan speed and the mass-to-charge ratio; and c) an analysis-performing section for performing an analysis of a target sample under the condition that the scan speed has been specified as one of the analysis conditions, while controlling the voltage-applying section on the basis of the bias voltage information stored in the memory section so that the DC bias voltage changes according to the specified scan speed and in response to a change in the mass-to-charge ratio due to the mass-scanning operation.

Effect of the Invention

In the quadrupole mass spectrometer according to the first aspect of the present invention, the bias voltage information that relates a scan speed at which the mass-to-charge ratio is scanned by the quadrupole mass filter to a DC bias voltage appropriate for the scan speed is stored beforehand, for example in a tabular form, in the memory section. This information can be prepared beforehand by a manufacturer in the course of a tuning process before the product is shipped from the manufacturer. It is also possible to further include a bias voltage information-obtaining section for obtaining the bias voltage information and storing the obtained information in the memory section, the bias voltage information being obtained by performing, for each of a plurality of selectable levels of the scan speed, the operation of monitoring the detection signal produced by the detector while changing the DC bias voltage applied to the quadrupole mass filter, to find a value of the DC bias voltage at which the intensity of the detection signal is maximized.

In any case, the bias voltage information is already stored in the memory section before the auto-tuning is performed. Accordingly, in the auto-tuning mode, the tuning section uses the bias voltage information to specify a DC bias voltage corresponding to an intended scan speed. Then, it determines a voltage condition that maximizes the intensity of a detection signal produced by the detector under the condition that the specified DC bias voltage is applied to the quadrupole mass filter by the voltage-applying section. The voltage condition is recorded as the auto-tuning result. In this mode of operation, it is preferable to specify the DC bias voltage for each of a plurality of selectable levels of the scan speed and perform the auto-tuning for each level of the scan speed while changing the DC bias voltage applied to the quadrupole mass filter. In an analysis of a target sample, when the scan speed is specified as one of the analysis conditions by an operator, the analysis-performing section performs the analysis of the target sample after determining an appropriate DC bias voltage on the basis of the bias voltage information stored in the memory section and setting the voltage condition determined by the tuning section.

According to this method, an auto-tuning operation for optimally or almost optimally setting the voltages applied to the relevant sections and other conditions is performed under the condition that an optimal or approximately optimal DC bias voltage for the speed of scanning the ion-selecting voltage is set in the quadrupole mass filter. In the analysis of a target sample, a DC bias voltage appropriate for the scan speed specified by the operator is automatically set. Therefore, the operator can perform the analysis of the sample under an appropriate DC bias voltage without any particular knowledge about the setting of the DC bias voltage in the auto-tuning. Thus, the detection sensitivity is maintained at high levels even if the scan speed is set at high levels.

Particularly, in the case where an appropriate DC bias voltage is determined for each of a plurality of selectable levels of the scan speed and the auto-tuning is performed for each level of the scan speed under the determined voltage condition, the analysis of a target sample can be performed with the DC bias voltage of the quadrupole mass filter appropriately specified so that an optimal analysis condition is created for whatever scan speed is selected by the operator.

In the quadrupole mass spectrometer according to the second aspect of the present invention, the bias voltage information stored in the memory section not only enables one appropriate DC bias voltage to be related to each level of the scan speed at which the mass-to-charge ratio is scanned by the quadrupole mass filter; it also enables a plurality of different DC bias voltages (some of which may be the same) corresponding to different mass-to-charge ratios to be related to the same scan speed. The information, which may be a tabular form as in the first aspect of the present invention, can be prepared beforehand by a manufacturer in the course of a tuning process before the product is shipped from the manufacturer. Alternatively, it may be prepared later for each product by actually carrying out a preliminary experiment (or auto-tuning operation) using a standard sample.

In any case, after the scan speed is specified, the analysis-performing section scans the mass-to-charge ratio over a predetermined mass range at the specified scan speed. During this process, it controls the voltage-applying section on the basis of the bias voltage information stored in the memory section so that the DC bias voltage will correspond to the specified scan speed and sequentially change according to a change (increase or decrease) in the mass-to-charge ratio due to the mass-scanning operation. Generally, the detection sensitivity tends to deteriorate as the scan speed increases. Particularly, within a range where the scan speed is relatively high, the detection sensitivity remarkably decreases as the mass-to-charge ratio of the target ion increases. Taking this tendency into account, the bias voltage information is stored in the memory section. This information is intended to correct the decrease in the detection sensitivity resulting from a difference (high/low) in the scan speed and a difference (large/small) in the mass-to-charge ratio. Based on this information, the analysis-performing section adjusts the DC bias voltage applied to the quadrupole mass filter. Thus, compared to conventional ones, the quadrupole mass spectrometer according to the second aspect of the present invention can assuredly improve the detection sensitivity in the case where the scan speed is set at high levels.

However, increasing the DC bias voltage applied to the quadrupole mass filter to raise the passing speed of the ions simultaneously deteriorates the mass resolution of the mass spectrum. To deal with this problem, the memory section may preferably hold a first set of bias voltage information for specifying the DC bias voltage to correct a decrease in the detection sensitivity in the case where the scan speed is relatively high and a second set of bias voltage information for specifying the DC bias voltage to correct the decrease in the detection sensitivity to a smaller extent or not correct the decrease at all.

With this configuration, for example, if a component having a relatively low concentration is to be analyzed, a mass spectrum can be obtained with high detection sensitivity by using the first set of bias voltage information. On the other hand, if a component having a relatively high concentration is to be analyzed, or if the analysis requires a particularly high mass resolution, a mass spectrum with a high mass resolution can be obtained by using the second set of bias voltage information.

As a mode of the quadrupole mass spectrometer according to the second aspect of the present invention, the analysis-performing section may perform the mass analysis while switching the DC bias voltage between two modes based on the first and second sets of bias voltage information stored in the memory section in the case where the mass-scanning action over a predetermined mass range is repeated. Specifically, for example, the DC bias voltage setting may be alternately switched between one mode based on the first set of bias voltage information and another mode based on the second set of bias voltage information every time one or plural cycles of mass-scanning action are completed. This method enables both a mass spectrum with a high mass resolution and another mass spectrum with a high detection sensitivity to be simultaneously obtained by a single mass-analyzing process, so that the analysis can be more efficiently carried out while reducing the amount of the sample used.

EXPLANATION OF THE NUMERALS

1 . . . Ion Source
2 . . . Ion Optical System
3 . . . Quadrupole Mass Filter
3*a*, 3*b*, 3*c* and 3*d* . . . Rod Electrodes
4 . . . Detector
10 . . . Controller
11 . . . Input Unit
12 . . . Ion-Selecting Voltage Generator
13 . . . Ion-Drawing Voltage Generator
14, 15 . . . Voltage Adders
16 . . . Signal Processor
20 . . . Auto-tuning Data Memory Section
21 . . . DC Bias Voltage Table
22 . . . Auto-tuning Result Data
23 . . . Analysis Method Memory Section
24 . . . DC Bias Voltage Setting Table

BEST MODE FOR CARRYING OUT THE INVENTION

First Embodiment

Figures 1, 2:
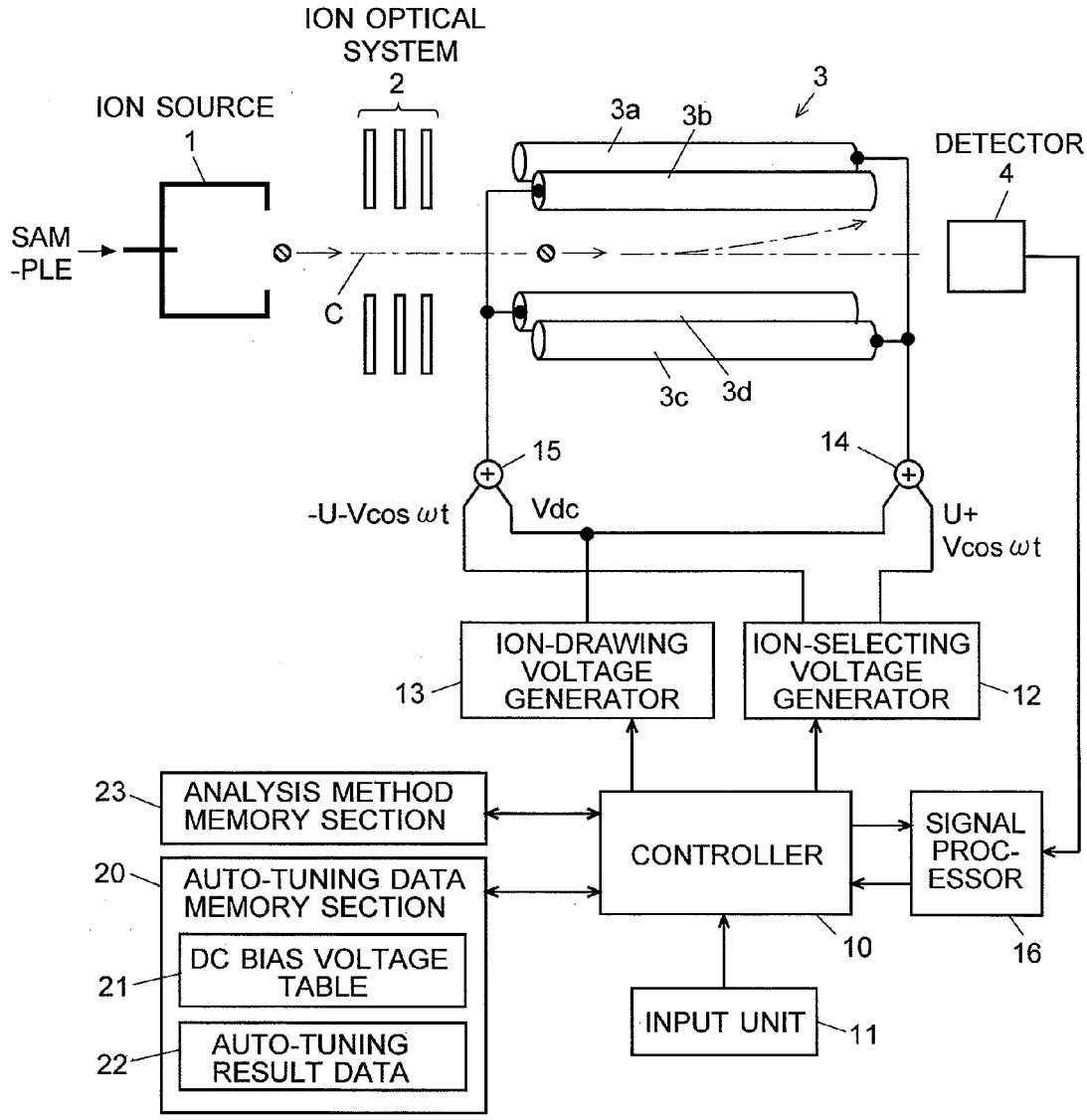
FIG. 1 is a schematic diagram of the main section of a quadrupole mass spectrometer according to the first embodiment of the present invention.
FIG. 2 shows the memory content of the DC bias voltage table in the quadrupole mass spectrometer of the first embodiment.

An embodiment of the quadrupole mass spectrometer according to the first aspect of the present invention is described with reference to the attached drawings (the first embodiment). FIG. 1 is a schematic diagram of the main section of the quadrupole mass spectrometer of the first embodiment.

As explained earlier, the apparatus has an ion source 1, an ion optical system 2, a quadrupole mass filter 3 and a detector 4. These are all enclosed in a vacuum chamber (which is not shown). In the quadrupole mass filter 3, four rod electrodes 3*a*, 3*b*, 3*c* and 3*d* are arranged so that they externally touch the inside of an imaginary cylindrical wall of a predetermined radius with its central axis lying on the ion beam axis C. Two rod electrodes opposing each other across the ion beam axis C are connected to each other, so that two rod electrodes neighboring each other in the circumferential direction are supplied with different voltages. To apply voltages to the rod electrodes 3*a* through 3*d*, an ion-selecting voltage generator 12, an ion-drawing voltage generator 13 and two voltage adders 14 and 15 are provided. The ion-selecting voltage generator 12 and the ion-drawing voltage generator 13 each generate a predetermined voltage under the control of the controller 10. Connected to this controller 10 are an auto-tuning data memory section 20 and an analysis method memory section 23. The auto-tuning data memory section 20 includes a DC bias voltage table 21 and an auto-tuning results data 22. An input unit 11 to be used by an operator is also connected to the controller 10.

The functions of the controller 10 are achieved by a system mainly including a computer having a CPU (central processing unit), a memory and other components. The auto-tuning data memory section 20 and the analysis method memory section 23 are realized by memory devices, such as a hard disk drive built into the computer. Though not shown in FIG. 1, there are other voltage generators that apply necessary voltages to the ion source 1, the ion optical system 2 and the detector 4, and the controller 10 also has the functions of controlling these voltage generators.

The ion-selecting voltage generator 12 includes a DC power source generating two DC voltages with different polarities, ±U, and a radio-frequency power source generating two AC voltages with a phase difference of 180 degrees, $\pm V \cos \omega t$, and superposes these voltages so that two voltage systems $\pm(U+V \cos \omega t)$ are created. The ion-drawing voltage generator 13 generates a DC bias voltage $V_{dc}$ to be commonly applied to the rod electrodes 3*a* through 3*d* so that these electrodes will have a voltage difference from the DC voltage applied to the ion optical system 2 located before the quadrupole mass filter 3. This voltage difference creates a DC electric field that efficiently introduces ions into the space extending along the major axis of the quadrupole mass filter 3. The voltage adder 14 adds the ion-selecting voltage $U+V \cos \omega t$ and the DC bias voltage $V_{dc}$ to produce a voltage $(V_{dc}+U)+V \cos \omega t$, which is applied to the rod electrodes 3*a* and 3*c*. The other voltage adder 15 adds the ion-selecting voltage $-U-V \cos \omega t$ and the DC bias voltage $V_{dc}$ to produce a voltage $(V_{dc}-U)-V \cos \omega t$, which is applied to the rod electrodes 3*b* and 3*d*.

When the aforementioned voltages are applied to the rod electrodes 3*a* through 3*d*, the mass-to-charge ratio m/z of an ion that can pass through the axially extending space of the quadrupole mass filter 3 is theoretically given by:

$$m/z=K(V/r^2\omega^2) \quad (4),$$

where K is a constant, and r is the radius of the inscribed circle of the rod electrodes 3*a* through 3*d*. This equation suggests that the mass-to-charge ratio m/z can be scanned by changing V. In actual scan measurements, for the purpose of stabilizing the flight of the ions, V is changed while satisfying the following relationship:

$$U=aV+b \quad (5),$$

where a and b are predetermined constants. This suggests that U also changes with V.

In the scan measurement, the mass resolution can be improved by reducing (or slowing) the speed of scanning the mass-to-charge ratio. However, this operation also decreases the repetition frequency of the scanning action per unit of time and thereby deteriorates the time resolution. Using such an apparatus as a detector for a gas chromatograph or liquid chromatograph may cause a situation where a sample component that is eluted only for a short period of time is overlooked. Accordingly, the scan speed should be appropriately set according to the purpose of analysis and the kind of the sample to be analyzed. For this purpose, in the mass spectrometer in this embodiment, the scan speed can be selected from ten levels from SS1 to SS10.

FIG. 2 shows the memory content of the DC bias voltage table 21 in the quadrupole mass spectrometer of the first embodiment. In the DC bias voltage table 21, each of the ten levels of scan speeds, which can be selected in the scan measurement as explained previously, is related to one appropriate DC bias voltage value $V_{dc}$. This relationship between the scan speed and the DC bias voltage can be determined and stored in the DC bias voltage table 21 by a manufacturer of the present apparatus before shipment from a factory.

A characteristic operation of the quadrupole mass spectrometer having the previously described configuration is described.

Generally, any mass spectrometer requires tuning before it is used. Accordingly, an operator enters an auto-tuning start command through the input unit 11. Upon receiving this command, the controller 10 performs an auto-tuning routine according to a specific program. Initially, the controller 10 sets the scan speed at SS1 and refers to the DC bias voltage table 21 to obtain the DC bias voltage $V_{dc1}$ corresponding to the scan speed SS1. Then, it sets the tuning conditions so that the output voltage of the ion-drawing voltage generator 13 is fixed at $V_{dc1}$ while other voltage conditions (e.g. the voltage applied to the ion optical system 2, the output voltage of the ion-selecting voltage generator 12, and the voltage applied to the detector 4) are appropriately changed.

A standard sample (which is not shown) containing components of known kinds at known concentrations is introduced into the ion source 1, which ionizes the components contained in the standard sample. The ions produced by the ion source 1 are extracted from the ion source 1 and accelerated toward the ion optical system 2 by an electric field created by a potential difference between the ion source 1 and the ion optical system 2. After being converged (and accelerated in some cases) by the ion optical system 2, the ions are introduced into the axially extending space of the quadrupole mass filter 3. A portion of these ions passes through the quadrupole mass filter 3 and reaches the detector 4, which produces detection signals corresponding to the amount of these ions.

Since the mass-to-charge ratio of an ion to be analyzed is constant, its detection signal changes when the voltage conditions of the aforementioned sections are changed as stated earlier and the possibility for the ion to reach the detector 4 is thereby changed. Accordingly, a signal processor 16 is monitoring the detection signal, and when the detection signal is maximized, the controller 10 regards the voltage conditions at that point in time as the optimal conditions and stores them into the auto-tuning result data 22. After the optimal conditions for the scan speed SS1 are determined, the controller 10 changes the scan speed to SS2 and refers to the DC bias voltage table 21 to obtain the DC bias voltage $V_{dc2}$ corresponding to the scan speed SS2. Then, it sets the tuning conditions so that the output voltage of the ion-drawing voltage generator 13 is fixed at $V_{dc2}$ while the voltage applied to the ion optical system 2, the output voltage of the ion selecting voltage generator 12, the voltage applied to the detector 4 and other voltages are appropriately changed. Subsequently, as in the case of the scan speed SS1, the optimal conditions for the scan speed SS2 are determined and stored into the auto-tuning result data 22.

By repeating this process until the scan speed S10, the optimal conditions for each of the scan speeds SS1 through SS10 are determined and stored into the auto-tuning result data 22. Thus, auto-tuning is completed.

Subsequently, when a scan measurement of a target sample is to be initiated, the operator 11 specifies, through the input unit 11, the mass range, the scan speed and other necessary parameters for the mass analysis. The scan speed should be selected from the levels SS1 through SS10, as explainer earlier. The analysis conditions thus specified will be organized in the form of a file and saved in the analysis method memory section 23.

When the scan speed is specified, the controller 10 refers to the DC bias voltage table 21 to obtain the DC bias voltage corresponding to that speed and fixes the output voltage of the ion-drawing voltage generator 13 at that voltage. Furthermore, the controller 10 derives the optimal condition values corresponding to the specified scan speed from the auto-tuning result data 22 and, based on the derived values, determines the voltages applied to the ion optical systems 2 and the detector 4. Also determined are the initial value of the voltage generated by the ion-selecting voltage generator 12 and various parameters for the voltage-scanning operation, e.g. the constants a and b in equation (5).

Generally, raising the scan speed increases the DC potential difference between the ion optical system 2 and the quadrupole mass filter 3, causing an increase in the kinetic energy of an ion at a point in time where the ion is introduced into the quadrupole mass filter 3. A higher kinetic energy of an ion at the inlet of the quadrupole mass filter 3 makes the ion fly at a higher speed and reduces the time required for the ion to pass through the axially extending space. This means that the passing time t of the ion in FIG. 11(*b*) decreases while the gradient of the voltage change ΔV is unchanged, so that the practical voltage change during the time t becomes smaller. As a result, the ion will be less affected by the voltage change, and the ion that is intended to pass through will more easily pass through. Thus, more ions will reach the detector 4 and the detection sensitivity will be improved.

By the previously described configuration, the auto-tuning is performed at an optimal DC bias voltage corresponding to each scan speed so that optimal conditions are determined for each scan speed; when an analysis of a target sample is actually performed, the optimal DC bias voltage corresponding to the scan speed specified by the operator is set and the optimal conditions adjusted under the optimal DC bias voltage are set, so that the objective ions pass through the quadrupole mass filter 3 with high probability. However, the auto-tuning may require a rather long period of time since it is intended to determine optimal conditions for every scan speed. This problem can be avoided by presetting one typical scan speed for the auto-tuning, determining the DC bias voltage corresponding to the preset scan speed, and finding optimal conditions under that DC bias voltage. In this case, although the auto-tuning is not always performed under a DC bias voltage corresponding to the scan speed specified by the operator, the subsequent analysis can practically be performed with only a minor decrease in the detection sensitivity.

In the first embodiment, the DC bias voltage table is stored in the auto-tuning data memory section beforehand, and it is not expected that users will later change or modify the table. However, if the condition of the apparatus has been varied due to secular changes, part replacements or other reasons, changing the DC bias voltage table will probably result in better analysis results. Accordingly, the apparatus may be provided with the function of scanning the DC bias voltage while monitoring the detection signal produced by the detector 4. Using this function, the DC bias voltage table can be renewed or updated by finding a DC bias voltage at which the detection signal is maximized. This function may be implemented either as a part of the auto-tuning operation or as an independent process.

Second Embodiment

Figures 3, 4:
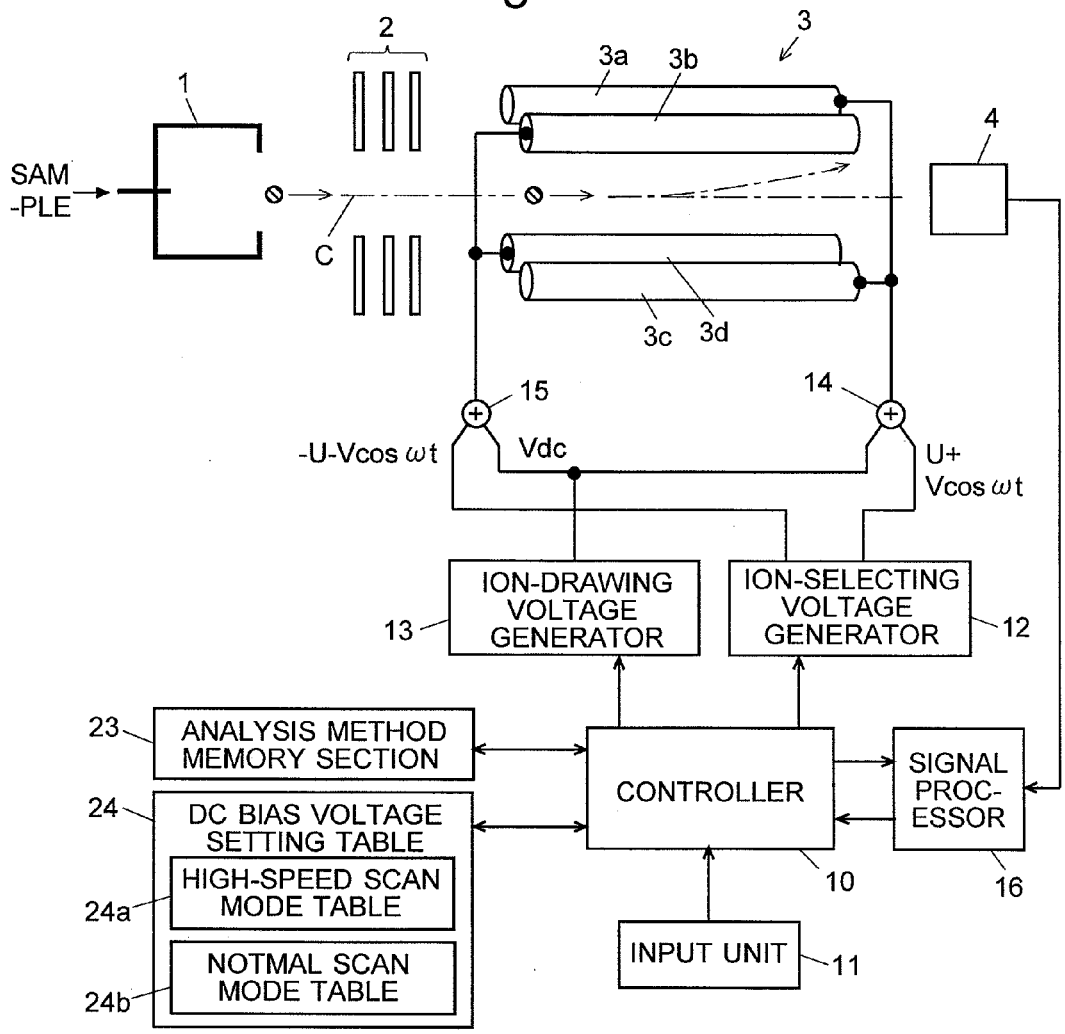
FIG. 3 is a schematic diagram of the main section in a quadrupole mass spectrometer according to the second embodiment of the present invention.
FIG. 4 shows the memory content of the DC bias voltage table in the quadrupole mass spectrometer of the second embodiment.

An embodiment of the quadrupole mass spectrometer according to the second aspect of the present invention is described with reference to the attached drawings (the second embodiment). FIG. 3 is a schematic diagram of the main section of the quadrupole mass spectrometer of the second embodiment. The following description omits detailed explanation of such components that are identical or equivalent to those of the quadrupole mass spectrometer of the first embodiment shown in FIG. 1.

In a scan measurement over a predetermined mass range, the controller 10 controls the ion-drawing voltage generator 13 according to the parameters read from the DC bias voltage setting table 24. The ion-drawing voltage generator 13 in turn applies a predetermined DC bias voltage $V_{dc}$ to the voltage adders 14 and 15, respectively. To improve the detection sensitivity or mass resolution, the quadrupole mass spectrometer of the second embodiment controls the DC bias voltage $V_{dc}$ so that it changes not only according to the scan speed but also according to the mass-to-charge ratio, which is sequentially changed by the scanning operation.

Figure 5:
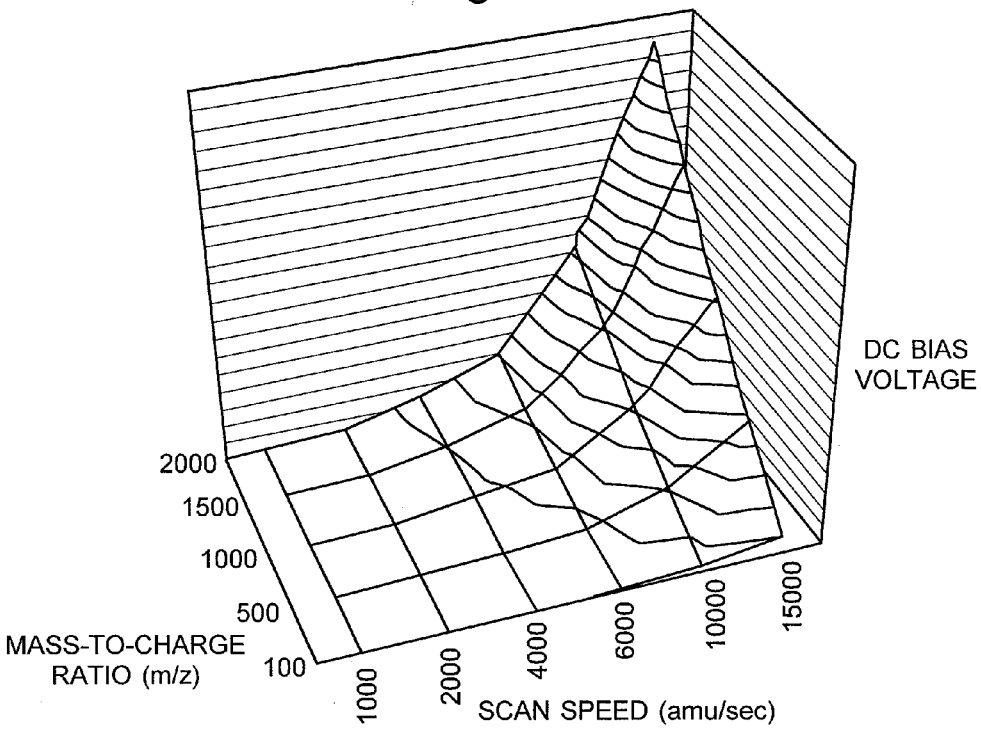
FIG. 5 is a chart showing a relationship of the scan speed, mass-to-charge ratio and DC bias voltage of the quadrupole mass filter under conditions where the mass analysis can be correctly performed.
Figures 11, 12:
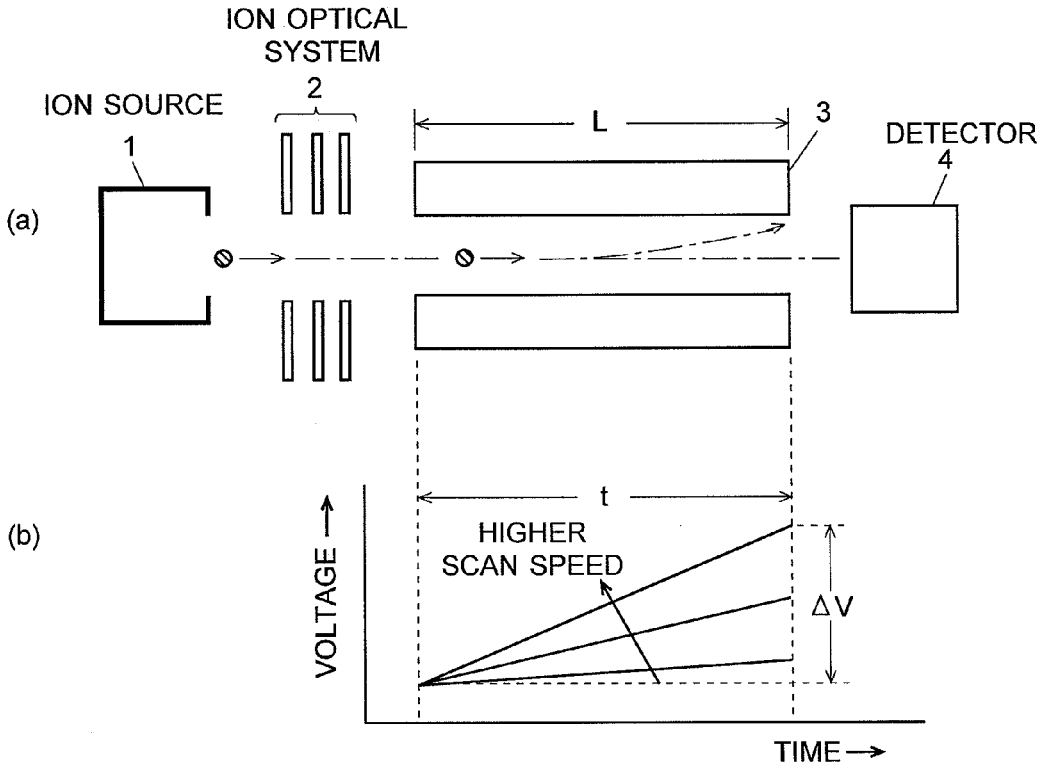
FIG. 11(*a*) is a schematic diagram showing the principle of a quadrupole mass spectrometer, and FIG. 11(*b*) is a graph showing a relationship between the passing time of an ion and the magnitude of change in the DC bias voltage applied to the quadrupole mass filter.
FIG. 12 is a table showing a relationship between the scan speed and the time required for measuring one mass unit.

A method of determining an appropriate DC bias voltage is as follows: As stated earlier, the speed v of an ion having a mass m is given by:

$$(1/2)mv^2=eE \quad (1),$$

where E is the ion-drawing bias voltage and e is the elementary electric charge. The relationship between the scan speed and the measurement time per one mass unit is as shown in FIG. 12. Using these items of information, it is possible to calculate the relationship of the scan speed, the mass-to-charge ratio and the DC bias voltage of the quadrupole mass filter under appropriate mass analysis conditions, i.e. the conditions under which an ion that has passed through the quadrupole mass filter can reach the detector within the data measurement cycle. The calculated result is shown in FIG. 5. As is clearly seen from this figure, when the scan speed is low (e.g. 1000 or 2000), it is unnecessary to change the DC bias voltage according to the mass-to-charge ratio. On the other hand, when the scan speed is high, it is necessary to increase the DC bias voltage with the mass-to-charge ratio.

Figure 6:
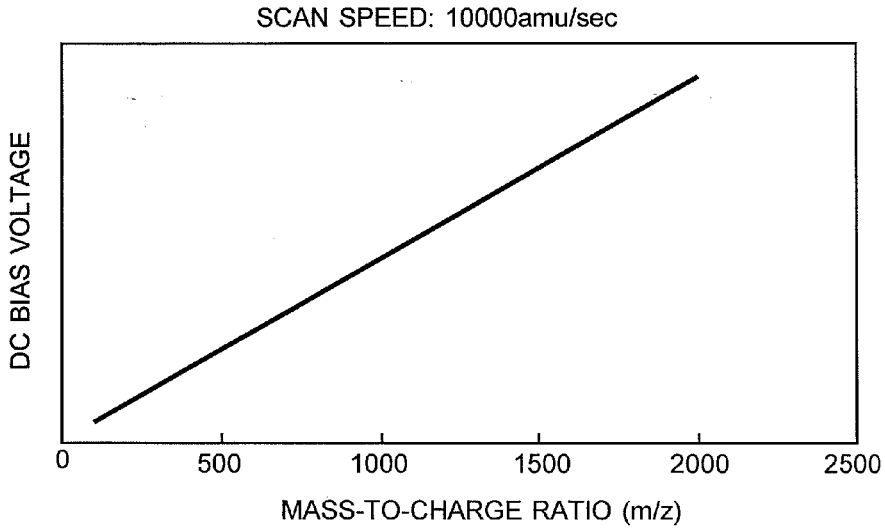
FIG. 6 is a graph showing the relationship between the mass-to-charge ratio and the DC bias voltage for a constant scan speed (10000 amu/sec), based on FIG. 5.
Figure 7:
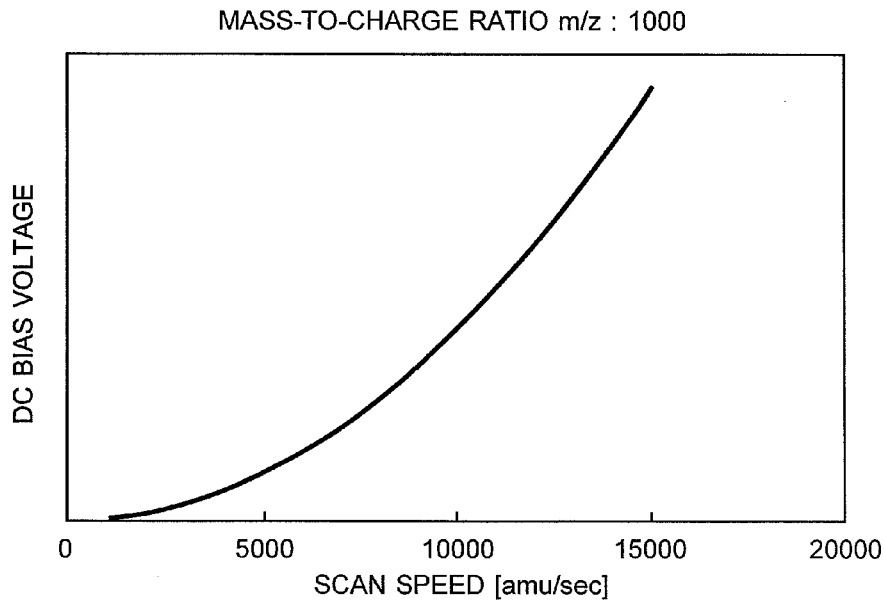
FIG. 7 is a graph showing the relationship between the scan speed and the DC bias voltage for a constant mass-to-charge ratio (m/z 1000), based on FIG. 5.

FIGS. 6 and 7 are two-dimensional sections of FIG. 5. Specifically, FIG. 6 is a graph showing the relationship between the mass-to-charge ratio and the DC bias voltage for a constant scan speed (10000 amu/sec), and FIG. 7 is a graph showing the relationship between the scan speed and the DC bias voltage for a constant mass-to-charge ratio (m/z 1000). FIG. 7 shows that, in an analysis of an ion having a given mass-to-charge ratio (m/z 1000 in the present case), if the scan speed is increased, the DC bias voltage needs to be increased approximately proportional to the square of the scan speed. FIG. 6 shows that, during a mass-scanning operation in which the mass-to-charge ratio is controlled so that it increases at a constant (i.e. specific) scan speed (which is 10000 amu/sec in the present case), the DC bias voltage must be almost linearly increased. In conventional quadrupole mass spectrometers, the necessity for changing the DC bias voltage as shown in FIG. 6 was not noticed, although changing the DC bias voltage as shown in FIG. 7 was regarded as necessary.

Figure 8:
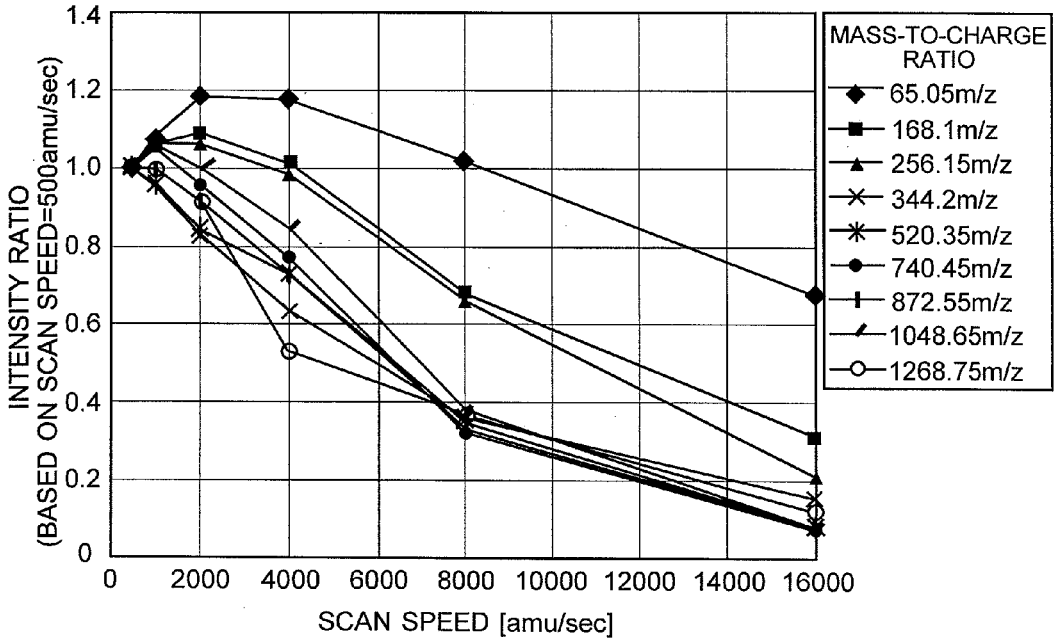
FIG. 8 is a graph showing changes of the detection sensitivity measured for different mass-to-charge ratios under a constant DC bias voltage.
Figure 9:
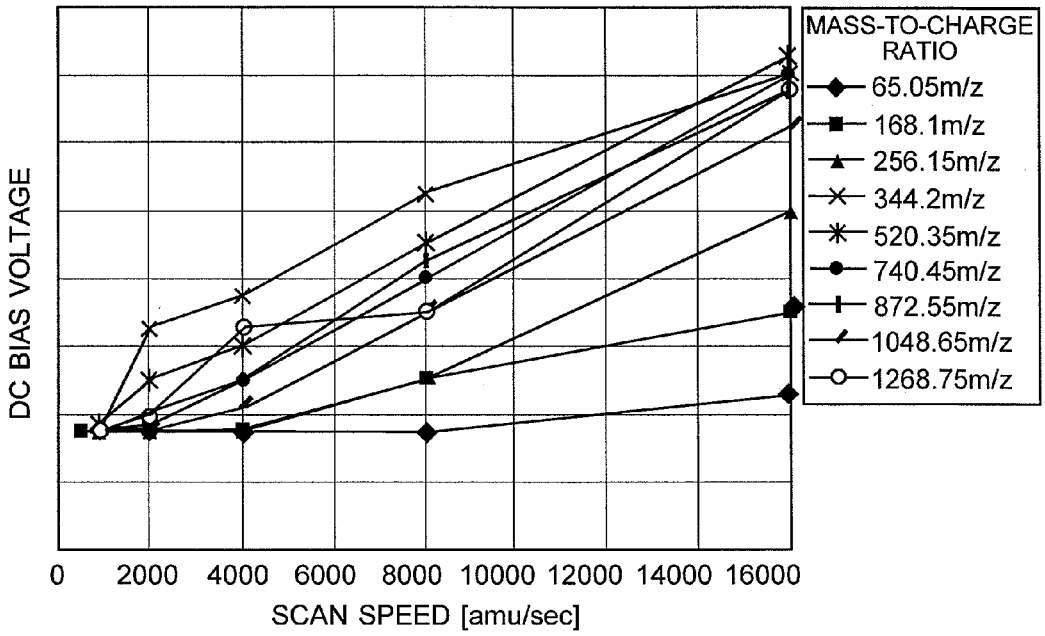
FIG. 9 is a graph showing a relationship between the DC bias voltage and the scan speed, the DC bias voltage being adjusted so that the changes of the detection sensitivity shown in FIG. 8 is cancelled.

FIG. 8 is a graph showing changes of the detection sensitivity measured for different mass-to-charge ratios under a constant DC bias voltage. FIG. 8 clearly shows that the detection sensitivity deteriorates as the mass-to-charge ratio increases. In view of this problem, a relationship of the DC bias voltage to the scan speed and the mass-to-charge ratio was investigated while attempting to adjust the DC bias voltage so as to correct the deterioration of the detection sensitivity and maintain the detection sensitivity approximately constantly. The result is as shown in FIG. 9. By measuring this relationship beforehand and determining an appropriate DC bias voltage for each combination of the scan speed and the mass-to-charge ratio, it is possible to create a table as shown in FIG. 4. This table can be saved as the high-speed scan mode table 24*a* of the DC bias voltage setting table 24.

The aforementioned table may be created by an auto-tuning operation as described in the first embodiment. However, the table can be normally prepared beforehand by a manufacturer of the apparatus since the table is likely to change scarcely from one apparatus to another and barely suffer from secular changes due to a long period of usage.

Applying a DC bias voltage intended to correct the sensitivity deterioration as described previously will cancel the sensitivity deterioration. However, it will also cause a deterioration of the mass resolution. In view of this problem, another table is prepared for calculating a DC bias voltages that is not intended to correct the sensitivity deterioration caused by increasing the mass-to-charge ratio. This table is saved as a normal scan mode table 24*b* of the DC bias voltage setting table 24. When performing an analysis, the operator selects one of the two modes according to the purpose of analysis and/or the mass range. According to the mode selection, the controller 10 can switch the table to use.

Figure 10:
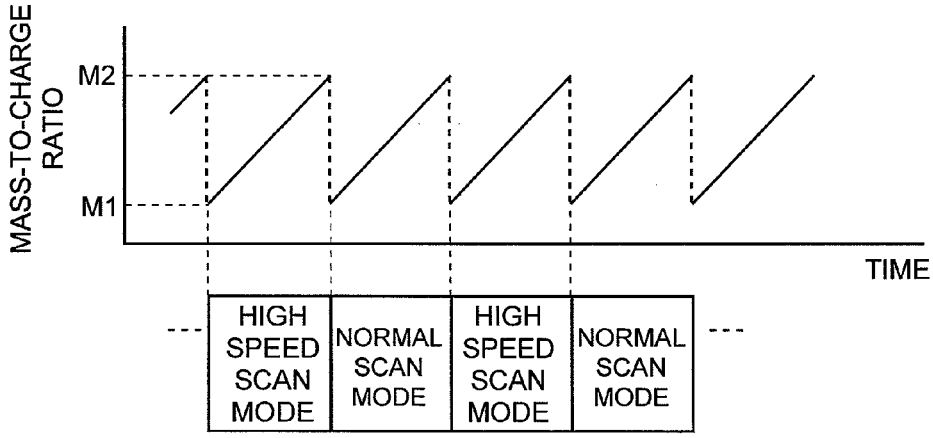
FIG. 10 shows an example of a mode-switching operation in a scan measurement.

In a scan measurement in which the same mass range is repeatedly scanned, the controller 10 may change the DC bias voltage setting by alternately switching the operational mode between the high-speed scan mode and the normal scan mode every time one cycle (or plural cycles) of mass-scanning action is completed, as shown in FIG. 10. The data collected in the two different modes can be used to create two mass spectrums. According to this method, two mass spectrums can be simultaneously obtained by a single mass analysis; one mass spectrum is created with a high mass resolution but relatively low sensitivity and the other with a high sensitivity but relatively low mass resolution.

It should be noted that the embodiments described thus far are mere examples. It is clear that any changes, additions or modifications appropriately made to those examples within the spirit and scope of the present invention should be included in the scope of the claims of the present patent application.

The invention claimed is:

1. A quadrupole mass spectrometer including an ion source for ionizing sample molecules, a quadrupole mass filter for selectively allowing passage of an ion having a specific mass-to-charge ratio among ions produced by the ion source, an ion optical system located between the ion source and the quadrupole mass filter in order to transport the ions produced by the ion source to the quadrupole mass filter, and a detector for detecting an ion that has passed through the quadrupole mass filter, comprising:

a) a voltage-applying ion-drawing section for applying a DC bias voltage to the quadrupole mass filter in order to create a DC electric field for drawing the ions into the quadrupole mass filter, the DC electric field being created between the quadrupole mass filter and the ion optical system;

b) a memory section for storing beforehand bias voltage information utilized in the ion-drawing section, the bias-voltage information including a plurality of scan speeds and, for each scan speed, a specific mass-to-charge ratio and a specific DC bias voltage; and c) an analysis-performing section for performing an analysis of a target sample under a condition that the scan speed has been specified as one of analysis conditions, while controlling the voltage-applying ion-drawing section on a basis of the bias voltage information stored in the memory section so that the DC bias voltage changes according to the specified scan speed and in response to a change in the mass-to-charge ratio due to a mass-scanning operation.

2. The quadrupole mass spectrometer according to claim 1, wherein the memory section holds a first set of bias voltage information for specifying the DC bias voltage to correct a decrease in detection sensitivity in the case where the scan speed is relatively high and a second set of bias voltage information for specifying the DC bias voltage to correct the decrease in the detection sensitivity to a smaller extent or not correct the decrease at all.

3. The quadrupole mass spectrometer according to claim 2, wherein the analysis-performing section performs a mass analysis while switching the DC bias voltage between two modes based on the first and second sets of bias voltage information stored in the memory section in a case where a mass-scanning action over a predetermined mass range is repeated.

4. The quadrupole mass spectrometer according to claim 1, wherein the memory section holds the bias voltage information in a tabular form.

5. The quadrupole mass spectrometer according to claim 3, wherein the analysis-performing section switches a DC bias voltage setting between one mode based on the first set of bias voltage information and another mode based on the second set of bias voltage information every time one or plural cycles of mass-scanning action are completed.

6. The quadrupole mass spectrometer according to claim 3, wherein the auto-tuning section has an operational mode in which one typical level of the scan speed for the auto-tuning is preset, the DC bias voltage corresponding to the typical level of the scan speed is determined, and optimal conditions are found under the determined DC bias voltage.

7. The quadrupole mass spectrometer according to claim 2, further comprising a mode selector by which an operator selects a high-speed scan mode or a normal scan mode according to a purpose of analysis and/or the mass range, wherein the analysis-performing section switches the bias voltage information between the first set of bias voltage information and the second set of bias voltage information based on the selected mode.

8. The quadrupole mass spectrometer according to claim 3, wherein the analysis-performing section changes the DC bias voltage setting by alternately switching an operational mode between a high-speed scan mode based on the first set of bias voltage information and a normal scan mode based on the second set of bias voltage information every time one or plural cycles of mass-scanning action are completed, and the analysis-performing section creates mass spectrums by using data collected in the two scan modes, respectively.

* * * * *